US005695171A

United States Patent [19]

Shine

[11] Patent Number: 5,695,171

[45] Date of Patent: Dec. 9, 1997

[54] FLASHING REMOVAL TOOL

[76] Inventor: William Shine, 10 Emily Ct., Warwick, N.Y. 10990

[21] Appl. No.: 499,454

[22] Filed: Jul. 7, 1995

Related U.S. Application Data

[63] Continuation-in-part of Ser. No. 429,174, Apr. 26, 1995, Pat. No. 5,577,711.

[51] Int. Cl.[6] ..... B25C 11/00

[52] U.S. Cl. ..... 254/25; 81/45

[58] Field of Search ..... 81/45, 46; 30/169; 254/25, 21, 131, 131.5

[56] References Cited

U.S. PATENT DOCUMENTS

| | | | |
|---|---|---|---|
| 2,103,008 | 12/1937 | Kinast | 254/21 |
| 2,863,635 | 12/1958 | Fandrich | 254/25 |
| 3,987,827 | 10/1976 | Mills | 254/25 |
| 5,207,126 | 5/1993 | Schaben | 254/25 |
| 5,322,264 | 6/1994 | Giambro | 254/25 |

FOREIGN PATENT DOCUMENTS

| | | | |
|---|---|---|---|
| 500939 | 6/1930 | Germany | 254/25 |

*Primary Examiner*—Robert C. Watson
*Attorney, Agent, or Firm*—Terrance L. Siemens

[57] ABSTRACT

An improved pry bar tool for removing step flashing from a building during roof replacement or like service. The tool is configured to receive a nail on right and left sides and on either terminal end, at any of a number of possible nail pulling notches or grooves. The two ends are offset differently, so that a variety of pulling positions is offered. Enlarged heads for receiving hammer blows from all angles enable the tool to be tapped while maneuvering to remove a nail from the flashing. The novel tool is able to remove nails expeditiously from flashing without distorting or destroying the flashing, so that it is reusable.

11 Claims, 1 Drawing Sheet

10
12
14
16
18
19
22
26
28
30
32
36
36A
38
40
42
44
50
51
60
61
70
1
2
3
4
5
N

FLASHING REMOVAL TOOL

REFERENCE TO RELATED APPLICATION

This application is a Continuation-In-Part of Ser. No. 08/429,174, filed Apr. 26, 1995 now U.S. Pat. No. 5,577,711.

BACKGROUND OF THE INVENTION

1. Field of the Invention

The present invention relates to an improved tool for removing nails from roof flashing. The tool is a pry bar specially designed to enable removal of nails without damaging the flashing, which may then be reused.

2. Description of the Prior Art

When typical shingle or like building roofs are being repaired or renewed, it is frequently necessary to remove flashing therefrom. If this flashing could be removed intact, it could subsequently be reinstalled, since flashing is made from materials which resist natural deterioration. In fact, it is generally the act of removing flashing from an assembled roof that damages the flashing, rendering it unsuitable for further use.

Flashing is typically nailed into place, partially covered by shingles or other roofing materials, and may be caulked by tar or other natural or synthetic sealing materials. A suitable tool for removing the nails is normally employed to remove flashing.

Nail removing tools are well known in the prior art. One such tool has as its purpose removal of nails from shingles, shake, and the like while preserving underlying felt. This tool, described in U.S. Pat. No. 5,207,126, issued to Bernard J. Schaben on May 4, 1993, comprises a generally L-shaped strip of flat stock, the longer leg bearing grooves for engaging nails. This longer leg is slightly bent so that it does not lie in a plane. Schaben's tool lacks lateral impact receiving structures and the arrangement of nail engaging grooves of the present invention. Also, curvature of the strip stock is different from that of the present invention.

The following patents present individual features which bear remotely upon the novel structure. The similarities will be noted, but closer examination will reveal that none of these devices would be suitable for duty as envisioned and provided for by the present invention.

A tack pulling bar is set forth in U.S. Pat. No. 743,183, issued to William C. Miller on Nov. 3, 1903. The bar has curvature vaguely similar to that of the present invention. However, this bar has but one fastener engaging groove, which is disposed in a different location from any of the present invention. This bar also lacks the impact receiving members of the present invention.

Two pry bars are shown in U.S. Pat. No. 542,989, issued to Jesse S. Brooks on Jul. 23, 1895, and U.S. Pat. No. 569,552, issued to Oscar E. Dunaway et al. on Oct. 13, 1896. The device of Dunaway et al. includes a structure attached to and perpendicular to the main shaft. Although the present invention includes structure located roughly at the same location, and generally similarly oriented, the structure of Dunaway et al. is ill suited to receiving hammer blows in the same manner as that of the present invention.

Both bars move in a plane perpendicular to motion of the novel tool. They must therefore be of sufficient thickness in a dimension which would defeat their use in the manner of the present invention. Also, their respective nail engaging grooves are arranged differently from those of the present invention.

U.S. Pat. No. 1,656,652, issued to Theodore Thorson on Jan. 17, 1928, describes a claw hammer adapted to include nail engaging grooves located laterally on the claws, generally in the manner of the present invention. However, configuration of the typical hammer head departs radically from the construction of the present invention.

None of the above inventions and patents, taken either singly or in combination, is seen to describe the instant invention as claimed.

SUMMARY OF THE INVENTION

The present improved invention is particularly suited for removing flashing from a building when replacing all or part of the roof, with an eye towards preserving this flashing in a condition suitable for reusing the same. When flashing is being removed, access to nails securing the flashing to the building may be impaired by proximity to surrounding building elements. This situation may require probing with a pry bar, and pulling the pry bar backwardly to engage a nail successfully.

The novel pry bar is designed for reaching between closely spaced building elements, and has backwardly oriented nail receiving grooves. A plurality of grooves, groove locations, different offset schemes, and a variety of offset working heads give the user choice of positioning the pry bar most advantageously in order to maneuver the same.

Unique impact receiving structure enables the pry bar to be tapped while maneuvering the same once the nail is engaged. This is required due to the delicate nature of the task of removing flashing non-destructively.

Accordingly, it is a principal object of the improved invention to provide a pry tool which is insertable between building elements of close proximity, and to provide a choice of groove locations including grooves on each end on each lateral side and a groove on each terminal end which can engage a nail. One specific improvement to the prior art is the addition of the grooves located on each terminal end which provide additional means of engaging a nail for removal.

It is another object of the improved invention to enable the pry tool to be tapped from all directions while removing a nail.

It is another object of the improved invention to enable the pry tool to pry a nail installed in a roof, to which access is limited.

It is an additional object of the improved invention to enable the pry bar to be readily slid into engagement with a nail.

It is again an object of the improved invention to provide a variety of choices regarding leverage, position, and reach when wielding the pry tool.

It is an object of the improved invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figures 1, 2, 3:
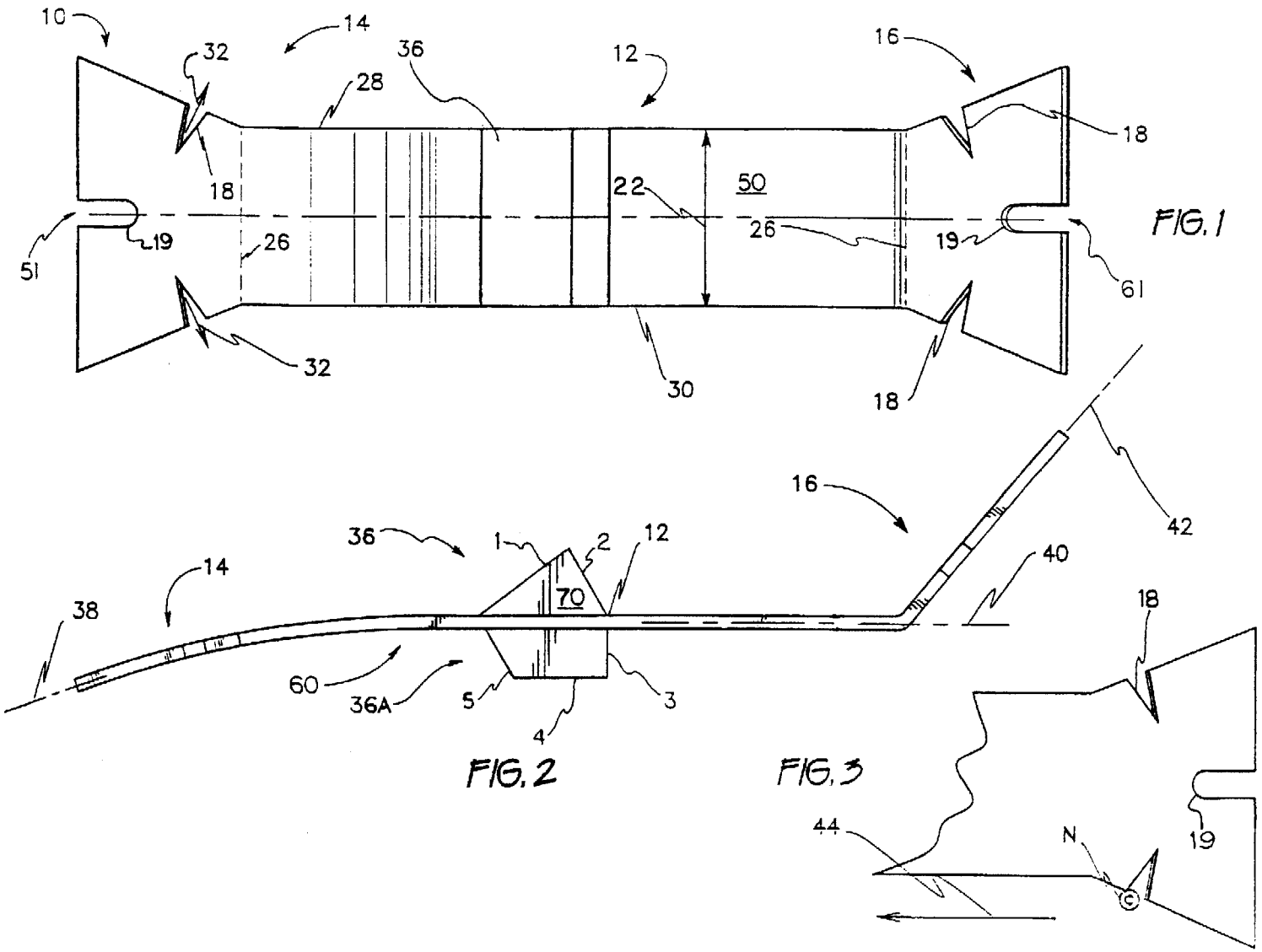
FIG. 1 is a top plan view of the improved invention.
FIG. 2 is a side elevational view of the improved invention.
FIG. 3 is a top plan detail view of the improved invention, illustrating engagement of a nail.

FIG. 1 shows the improved flashing removal tool 10 in top plan view to include a body having a central section 12, a first end portion 14, a second end portion 16, a first terminal end 51, and a second terminal end 61. End portions 14, 16 include notches or grooves 18 for engaging a nail (not shown) by slipping tool 10 under the broadened head of the nail, and drawing tool 10 into full engagement with the shaft of the nail. Terminal ends 51 and 61 include notches or grooves 19 for engaging a nail (not shown) by slipping tool 10 under the broadened head of the nail, and pushing tool 10 into full engagement with the shaft of the nail. This operation is conventional, and grooves 18 and 19 are conventionally bevelled for this purpose, as shown representatively at 20.

Tool 10 is preferably formed from an elongated strip of material, such as steel, for example, having width indicated by arrow 22 and length, indicated by longitudinal axis line 24. End portions 14, 16 are demarcated with regard to central section 12 by dashed lines 26, although this delineation is a convenience for semantic purposes only, and does not represent critical structure. The body of tool 10 is characterized by first and second lateral sides 28,30 which extend continuously, interrupted only by grooves 18. The thickness of tool 10 is not critical beyond providing requisite strength and rigidity. If fabricated from steel, it is anticipated that a thickness of one eight of an inch (3 mm) or three sixteenths of an inch (or up to 5 mm) would be adequate for removing most roofing nails currently installed.

Grooves 18 are oriented toward the opposite end portion 14 or 16. They need not open directly towards the respective opposite end portions 14 or 16, but have a component of direction which is so aligned. Each groove has a centerline 32 which, if analyzed according to orthogonal axis, will be seen to have a component 34 which is in fact oriented towards its opposite end portion 14 or 16. In the present example, component 34 is oriented towards end portion 16.

Grooves 19 are oriented toward the terminal ends 51 and 61 of tool 10 to allow the engagement of a nail (not shown) by applying minimal forward pressure.

Tool 10 also has two heads 36 and 36A for receiving impacts on surfaces. Head 36 has surfaces 1 and 2 for receiving impacts and transmitting same to the body. Head 36A has surfaces 3, 4, and 5, for receiving impacts and transmitting the same to the body. Head 36 is attached to the top 50, and head 36A is attached to the bottom 60, by welding, but any suitable attachment construction may be used. An additional lateral striking surface 70 is created by the combination of lateral sides of heads 36 and 36A for receiving impacts and transmitting the same to the body. It is anticipated that impacts will not be severe, since removal of flashing (not shown) is a delicate operation, and the impacts will likely be those of light tapping.

Heads 36 and 36A could, illustratively, also be formed by tabs (not shown) formed integrally with the body of tool 10, and suitably turned up at the ends to present a larger target for the hammer or other tapping tool. In any case, heads 36 and 36A are attached to the body of tool 10 at the top 50 and bottom 60, and are located between first and second end portions 14,16. Impact surfaces of heads 36 and 36A are preferably arranged at a non-perpendicular angle to the body of tool 10. This arrangement is preferred since tapping is most frequently effective when performed partly in a direction aligned with line segment 34, described above. However, non-perpendicular arrangement is not essential.

As seen in FIG. 1, each end portion 14,16 is of progressively increasing width as it extends from central section 12 of tool 10. This configuration assists in engaging nails, as will be explained hereinafter.

Turning now to FIG. 2, it will be seen that tool 10 is bent such that end portions 14,16 are offset from both central section 12 of tool 10, and from one another. Further, the angle of offset of either end portion 14 or 16 is different from that of the other end portion 16 or 14. Examination of this Figure will reveal that the plane of end portion 14, represented by line 38, is at an angle to the plane of central section 12, represented by line 40. It will further be seen that the plane of end portion 16, represented by line 42, is also at an angle to line 40, and the angles formed thereby are not equal. Moreover, end portion 14 and an adjacent portion of central section 12 are curved in the direction of offset of end portion 14.

The combinations afforded by the above number and locations of grooves 18, by location of grooves 18 on both end portions 14,16 of tool 10, and grooves 19 on both terminal ends 51 and 61 of tool 10 and by the variations of offset of end portions 14, 16 all combine to maximize the choices when positioning and moving tool 10 while extricating a nail. More specifically, mirror image arrangement of end portions 14,16 enables both right and left handed operation of tool 10. Choice of grooves provides variations in leverage, reach, and other important aspects of maneuvering tool 10 after a nail is successfully engaged. Curvature of one end of tool 10 provides a variably located fulcrum, given that a pry bar is an adaptation of a lever. The straight end, by contrast, provides a predictably fixed or constant location of the fulcrum.

Successful engagement of a nail is enhanced by the progressively widening design of end portions 14, 16. Referring now to FIG. 3, the significance of the progressively widening configuration of end portions 14 and 16 is explained. It would be possible to engage a nail N by drawing tool 10 in the direction of arrow 44. While in most cases it is advisable to exert at least a light force urging tool 10 in the direction of nail N simultaneously while drawing. However, the location and orientation of groove 18 reduces the amount of such lateral force. By contrast, it would be possible to pull the tool of Schaben past the nail in the absence of sufficient lateral force.

The features of tool 10 may be varied to suit different purposes. For example, to reduce cost, the number of grooves and tapping heads may be reduced. Also, one end portion may be formed without progressively widened configuration. The principal embodiment depicted in the Drawing Figures is felt to offer a substantial number of maneuvering choices from which a skilled mechanic may choose.

It is to be understood that the improved invention is not limited to the embodiments described above, but encompasses any and all embodiments within the scope of the following claims.

I claim:

1. An improved flashing removal tool having a body defining a central section, a top side, a bottom side, a first end portion, and a second end portion, said body comprising an elongated strip of material having a width, a length, a first lateral side and a second lateral side, said first end portion having means defining a groove for engaging a nail therein, said groove directed outwardly from the side of said tool body, a terminal end of said first end portion having means defining a first center groove for engaging a nail therein, a second terminal end of said second end portion having means defining a second center groove for engaging a nail therein, said tool further comprising a head for receiving impacts, said head attached to said elongated strip at said top side thereof, said head located between said first end portion and said second end portion of said elongated strip wherein, an exposed surface area of said head provides multiple impact receiving striking surfaces which enable said tool to be struck with a hammer while maneuvering the same once the nail is engaged.

2. The flashing removal tool according to claim 1, said head arranged at a non-perpendicular angle to said strip of material.

3. The flashing removal tool according to claim 1, further comprising a second head for receiving impacts, said second head attached to said elongated strip at said bottom side thereof, between said first end portion and said second end portion of said elongated strip of material.

4. The flashing removal tool according to claim 1, said first end portion being of progressively increasing width as it extends from said central section of said body.

5. The flashing removal tool according to claim 1, said body being bent such that said first end portion and said second end portion are offset from one another.

6. The flashing removal tool according to claim 1, said first end portion being offset from said central section of said body at a first angle, and said second end portion being offset from said central section of said body at a second angle.

7. The flashing removal tool according to claim 6, said first angle and said second angle being different from one another.

8. The flashing removal tool according to claim 5, said second end portion being curved in the direction of offset.

9. An improved flashing removal tool having:

a body defining a central section, a top side, a bottom side, a first end portion, and a second end portion, said body comprising an elongated strip of material having a width, a length, a first lateral side and a second lateral side, said first end portion being of progressively increasing width as it extends from said central section of said body, and having means defining a first lateral groove and a second lateral groove, each for engaging a nail formed therein, said first lateral groove located on said first lateral side of said body and said second lateral groove located on said second lateral side of said body, whereby a nail is engaged for withdrawing from a roof during right handed and left handed operation, said first lateral groove and said second lateral groove directed outwardly from the side of said tool body; and said tool further comprising a head for receiving impacts, said head attached to said elongated strip at said top side thereof, said head located between said first end portion and said second end portion of said elongated strip, and said head arranged at a non-perpendicular angle to said strip of material.

10. The improved flashing removal tool according to claim 9, further comprising a second head for receiving impacts, said second head attached to said elongated strip at said bottom side thereof, between said first end and said second end of said elongated strip.

11. An improved flashing removal tool having:

a body defining a central section, a first end portion, and a second end portion, said body comprising an elongated strip of material having a width, a length, a first lateral side and a second lateral side, said first end portion being of progressively increasing width as it extends from said central section of said body, and having means defining a first groove located on said first lateral side, and means defining a second groove located on said second lateral side, and means defining a third grove defining a third grove located on the center of said first terminal end, each groove for engaging a nail formed therein, whereby a nail is engaged for withdrawing from a roof during right handed and left handed operation, said first end portion being offset from said central section of said body at a first angle, said second end portion being of progressively increasing width as it extends from said central section of said body, said second end portion having means defining a fourth groove located on said first lateral side, and means defining a fifth groove located on said second lateral side, and means defining a sixth grove located on the center of said second terminal end portion, said fourth groove, said fifth groove and said sixth groove each for engaging a nail, said second end portion being offset from said central section of said body at a second angle, said first angle and said second angle being different from one another, one of said first end portion and said second end portion being curved in the direction of offset, and the other of said first end portion and said second end portion being straight; and said tool further comprising a first head and a second head for receiving impacts, said first head attached to said elongated strip on top side of said tool, located between said first end and said second end of said elongated strip, and arranged at a non-perpendicular angle to said strip of material, said second head attached to said elongated strip on bottom side of said tool, located between said first end and said second end of said elongated strip, whereby a user has a choice of grooves for engaging a nail at both ends of said tool, and whereby a nail is engaged for withdrawing from a roof during right handed and left handed operation, and whereby the user has a choice of grooves on said lateral sides and said end for engaging a nail for withdrawal.

* * * * *